US007532099B2

(12) United States Patent
Brunner

(10) Patent No.: US 7,532,099 B2
(45) Date of Patent: May 12, 2009

(54) INDUCTIVE COMPONENT AND METHOD FOR PRODUCING THE SAME

(75) Inventor: Markus Brunner, Bessenbach (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 0 days.

(21) Appl. No.: 10/476,901

(22) PCT Filed: Apr. 26, 2002

(86) PCT No.: PCT/EP02/04644

§ 371 (c)(1),
(2), (4) Date: May 6, 2004

(87) PCT Pub. No.: WO02/101763

PCT Pub. Date: Dec. 19, 2002

(65) Prior Publication Data

US 2004/0183643 A1 Sep. 23, 2004

(30) Foreign Application Priority Data

Jun. 8, 2001 (DE) ..... 101 28 004

(51) Int. Cl.
*H01F 27/02* (2006.01)

(52) U.S. Cl. ..... 336/83

(58) Field of Classification Search ..... 336/65, 336/83, 233, 181–202
See application file for complete search history.

(56) References Cited

U.S. PATENT DOCUMENTS

| | | | | |
|---|---|---|---|---|
| 3,255,512 A * | 6/1966 | Lochner et al. | ..... | 29/602.1 |
| 4,601,765 A * | 7/1986 | Soileau et al. | ..... | 148/104 |
| 4,923,533 A | 5/1990 | Shigeta et al. | | |
| 5,522,946 A | 6/1996 | Tomita et al. | | |
| 5,594,397 A * | 1/1997 | Uchikoba et al. | ..... | 333/202 |
| 6,373,368 B1 * | 4/2002 | Shikama et al. | ..... | 336/200 |
| 6,710,692 B2 * | 3/2004 | Kato et al. | ..... | 336/83 |
| 6,749,767 B2 * | 6/2004 | Mitani et al. | ..... | 252/62.54 |

FOREIGN PATENT DOCUMENTS

| | | |
|---|---|---|
| DE | 833493 | 7/1949 |
| DE | 10024824 | 11/2001 |
| JP | 59177902 | 10/1984 |
| JP | 63021807 | 1/1988 |
| JP | 05283238 | 10/1993 |
| JP | 05-299232 | 11/1993 |
| JP | 06-224023 | 8/1994 |
| JP | 10-092623 | 4/1998 |
| JP | 10-097913 | 4/1998 |
| JP | 2000-182845 | 6/2000 |
| JP | 2001-068324 | 3/2001 |

OTHER PUBLICATIONS

E. Wolfarth: "Ferromagnetic Materials vol. 2," p. 73 (1980).

* cited by examiner

*Primary Examiner*—Tuyen T. Nguyen
(74) *Attorney, Agent, or Firm*—Buchanan Ingersoll & Rooney PC

(57) ABSTRACT

The invention relates to an inductive component (10) whose soft-magnetic core (11) consists of a powder composite. Said powder composite is produced by mixing a ferromagnetic amorphous or nanocrystalline alloy powder with a ferromagnetic dielectric powder and a thermoplastic or duroplastic polymer. Unlike conventional injection-molded or cast soft-magnetic cores, cores from a composite comprising a dielectric ferromagnetic powder allow for packing densities of substantially more than 55% by volume.

20 Claims, 1 Drawing Sheet

INDUCTIVE COMPONENT AND METHOD FOR PRODUCING THE SAME

CROSS REFERENCE TO RELATED APPLICATIONS

This application is the U.S. national phase of International Application No. PCT/EP02/04644 filed on Apr. 26, 2002, which claims priority to German Patent Application No. 101 28 004.1 filed on Jun. 8, 2001, the contents of which are hereby incorporated by reference.

BACKGROUND

1. Field

The invention relates to an inductive component having at least one winding and a soft magnetic core made of a ferromagnetic material. In particular, the invention relates to inductive components having a soft magnetic core made of a powder composite.

2. Description of Related Art

Certain soft magnetic powder composites in the form of molded magnetic cores have been known for some time.

For one, molded powder composites made of powdered iron are known. By use of these magnetic cores, the permeability range is well covered from approximately 10 to 300. Saturation inductions of approximately 1.6 Tesla can be achieved with these magnetic cores. The application frequencies are typically below 50 kHz on account of the comparatively low specific resistance and the size of the iron particles.

In addition, molded powder composites made of soft magnetic crystalline iron-aluminum-silicon alloys are known. Using these powder composites, application frequencies of greater than 100 kHz can be achieved due to the comparatively higher specific resistance.

Particularly good saturation inductions and permeabilities can be achieved using powder composites based on crystalline nickel-iron alloys. Permeabilities ranging up to approximately 500 can be realized by precise adjustment of the nickel content. Using these powder composites, application frequencies of greater than 100 kHz are likewise possible because of the comparatively low magnetic reversal losses.

However, these three known powder composites can be processed only into molds having very simple geometric shapes, since the molding technologies currently available allow for only a limited scope. In particular, only annular cores and/or pot cores can be manufactured.

To avoid these disadvantages, it is known from DE 198 46 781 A1, for example, to process soft magnetic alloy powders using injection molding methods to produce ferromagnetic powder composites. In this regard, nanocrystalline alloys in particular are incorporated into an injection-moldable plastic, in particular a polyamide, and subsequently injection-molded to produce soft magnetic cores.

In addition, it is known to the applicant to cast nanocrystalline alloys with cast resins to produce ferromagnetic powder composites.

SUMMARY

Both the injection molding process and the casting process using cast resins have the disadvantage that maximum packing densities in the powder composites of only about 55 volume % relative to the processed alloy powder can be realized. Thus, the overall achievable permeability of the inductive component is limited. In addition, the achievable saturation induction of the powder composite is limited. The limitation of the overall permeability and the saturation induction in turn limit the component properties, in particular for storage inductors. Furthermore, an additional increase in the magnetic reversal losses due to leakage field losses occurs as a result of the high internal shearing of these powder composites, which likewise is disadvantageous.

The object of the present invention, therefore, is to increase the packing density within the powder composite. A further related object is to increase the effective permeabilities and the achievable saturation inductions, as well as to reduce the magnetic reversal losses in the resulting inductive components.

According to the invention, these objects are achieved by an inductive component having at least one winding and a soft magnetic core made of a ferromagnetic powder composite composed of a ferromagnetic alloy powder comprising an amorphous or nanocrystalline alloy and a ferromagnetic dielectric powder, in addition to a thermoplastic or duroplastic polymer.

The admixture of a ferromagnetic dielectric powder allows significantly higher ferromagnetic packing densities to be achieved. This results from the fact that limits are set for the particle sizes of the alloy powders when ferromagnetic alloy powders composed of amorphous or nanocrystalline alloys are used. As a rule, the alloy powders cannot be reduced to particle sizes <0.04 mm, since this would result in structural changes in the soft magnetic amorphous and nanocrystalline material, thus leading to a drastic increase in the coercitive field intensities. The rapid rise in the coercitive field intensity which then occurs results in a large increase in the iron losses during dynamic magnetization.

By the admixture of dielectric ferromagnetic powders the remaining "spaces" between the individual alloy particles can be "filled," since such powders can be manufactured in significantly finer particle size distributions.

In a particular embodiment, a powder composite is obtained having a saturation magnetization $B_s$>0.5 Tesla, and a permeability $10 \leqq \mu \leqq 200$.

BRIEF DESCRIPTION OF DRAWING

The drawing FIGURE shows a schematic cross-sectional view of an embodiment of an inductive component described herein, and a magnified schematic view of a portion thereof.

DETAILED DESCRIPTION OF SPECIFIC EMBODIMENTS

Figure 1:
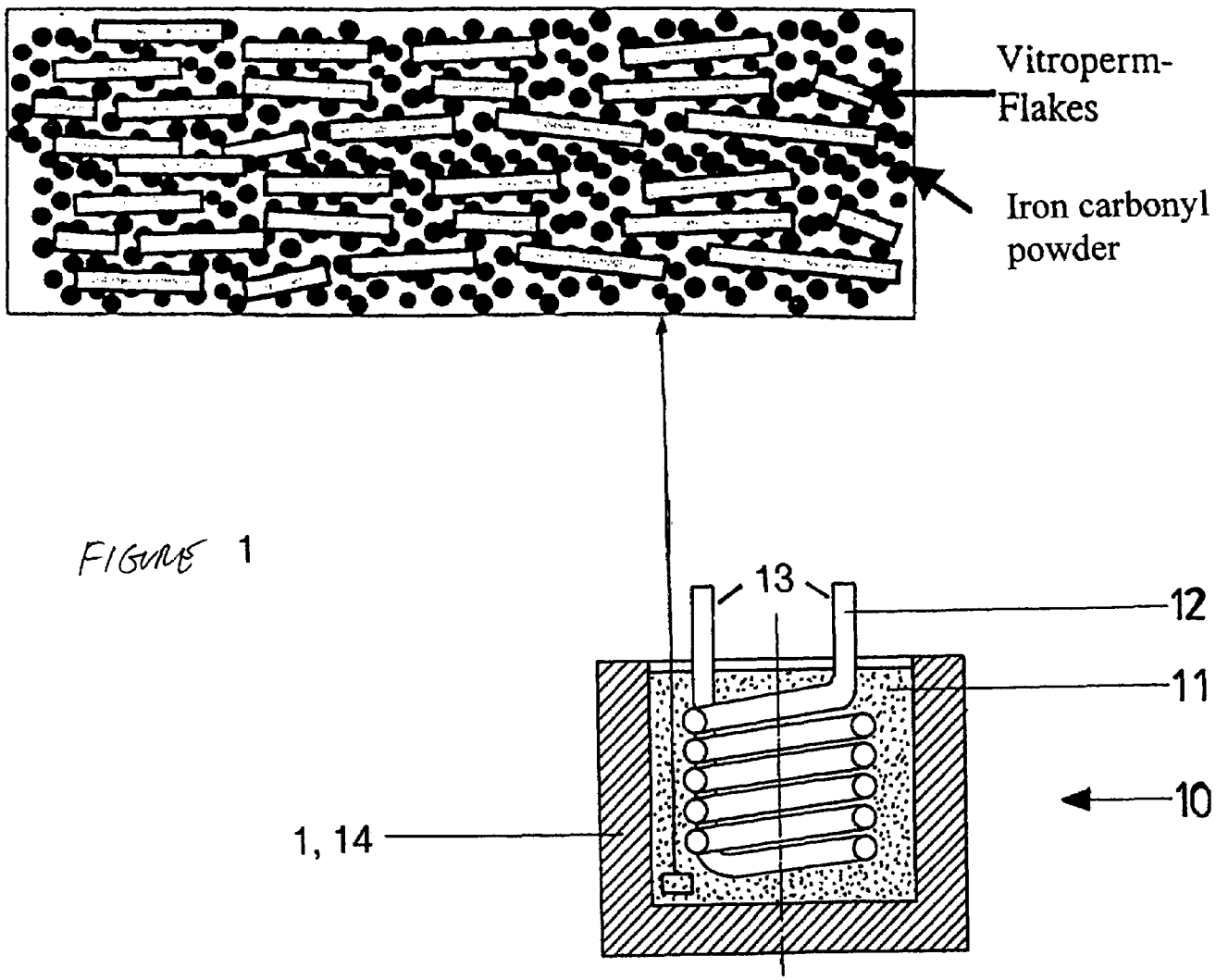

In one embodiment, inorganic powders, for example ferrite powders, are used as ferromagnetic dielectric powders. The ferrite powders are typically produced from sintered ferrite parts by grinding in suitable mills.

In particular, Mn—Zn ferrites (for example, N 27 ferrite) have proven to be particularly suitable on account of their high saturation induction.

In another embodiment, surface-insulated metallic powders are used. In particular, ferromagnetic metal carbonyl powders have proven to be exceptionally suitable. It is also possible to use iron carbonyl powder, nickel carbonyl powder, or cobalt carbonyl powder, as well as mixtures of these carbonyl powders.

The iron carbonyl powders are ultrapure iron powder produced by the "carbonyl process." Iron pentacarbonyl is produced from iron powder and carbon monoxide at elevated pressure and temperature. The iron carbonyl thus produced is subsequently separated from impurities by vacuum distillation, and then decomposed in a targeted manner into its starting substances, carbon monoxide and iron.

Iron powders with particle sizes between 0.5 and 10 μm are thus obtained. The particle size distribution may be set within specific limits by the targeted adjustment of the thermodynamic decomposition parameters.

The ultrapure fine-particle iron powder thus obtained naturally has a very low electrical resistance typical for metals, which in the use according to the invention is undesired. For this reason the powder is subsequently surface-insulated, for example surface-phosphated.

For the nickel carbonyl and cobalt carbonyl powders the procedure is analogous.

The iron powders and the surface-insulated metal powders have the common feature that both can be easily produced in powder particle sizes smaller than 10 μm. Particularly good results are obtained with dielectric ferromagnetic powders whose powder particles are smaller than 5 μm.

The powders used according to the present invention are consequently dielectric, which in this context means that they exhibit no appreciable electrical volume or surface conductivity. The formation of additional eddy current paths is thus avoided from the beginning.

The powders used preferably have a density which corresponds approximately to the density of the amorphous or nanocrystalline alloys used. This prevents the development of separation effects when the powders are mixed with the alloy powders. However, it is also possible to use powders with a density that differs greatly from the alloy powders used. Particular caution must be exercised, however, when the mixture is compressed.

Nanocrystalline alloys as described in detail in EP 0 271 657 A2 or EP 0 455 113 A2, for example, are used for the alloy powders. By use of the melt spin technology described therein, such alloys are typically produced in the form of thin alloy ribbons which initially are amorphous and then are subjected to heat treatment to achieve the nanocrystalline structure. However, amorphous alloys based on cobalt may also be used.

The alloys are ground into alloy powders with an average particle size <2 mm. Optimally, thicknesses are from 0.01 to 0.04 mm, and sizes in the other two dimensions, from 0.04 to 1.0 mm, more particularly between 0.04 mm and 0.5 mm.

The alloy particles are surface-oxidized to electrically insulate the particles from one another. One way to achieve this is by oxidizing the ground alloy particles in an oxygen-containing atmosphere. However, the surface oxidation can also be achieved by oxidizing the alloy ribbon before grinding into an alloy powder.

To further improve the insulation of the alloy particles from one another, they can be coated with a plastic, for example a silane or metal alkyl compound, the coating being carried out at temperatures between 80° C. and 200° C. over a period of 0.1 to 3 hours. By use of this procedure, the coating is "burned in" to the alloy particles.

In a first embodiment of the present invention, the alloy powder thus prepared is then mixed with the dielectric ferromagnetic powder in the desired proportions and subsequently mixed, together with an injection molding polymer as binder, in a heatable paddle mixer. In particular, polyamide 11 (Rilsan, for example) comes into consideration as injection molding polymer. If necessary, the formulation may be varied by using additional additives such as flow-conditioning agents or antioxidants, for example, as recommended by the manufacturer of the particular product. The material is melted, homogenized, and then granulated under refrigeration. The compound thus prepared can then be processed in customary injection molding machines designed for processing compounds densely packed with metal particles. The injection parameters are adjusted depending on the specific type of machine used and the molded article to be manufactured.

In an alternative, particularly preferred embodiment of the present invention, the mixture of alloy powder and dielectric ferromagnetic powder is cast with a casting resin, in particular a polyamide or polyacrylate.

In a first alternative the following process steps are carried out:

a) Preparation of a mold, an alloy powder, a dielectric powder, and a casting resin formulation;
b) Filling the mold with the alloy powder and the dielectric powder;
c) Pouring the casting resin formulation into the mold; and
d) Curing the casting resin formulation.

In a second alternative embodiment of the method, the following process steps are carried out:

a) Preparation of a mold, an alloy powder and a dielectric powder, and a casting resin formulation;
b) Mixing the alloy powder and the dielectric powder in addition to the casting resin formulation to produce a casting resin powder formulation;
c) Pouring the casting resin powder formulation into the mold; and
d) Curing the casting resin powder formulation.

In contrast to the injection molding process mentioned earlier above, the alloy particles are not subjected to any mechanical stress during the manufacturing process. In addition, particularly when a mold equipped with prefabricated windings is used, the insulation layer applied to the winding wires is not damaged because the casting resin formulation or casting resin powder formulation poured into the mold has the lowest possible viscosity by virtue of being gently introduced. Casting resin formulations with viscosities of several millipascal seconds are particularly preferred.

In a further embodiment of the present invention, in particular for achieving large filling heights in the mold, it has proven to be particularly advantageous when the alloy powder mixed with the dielectric powder is mixed with the casting resin formulation before being poured into the mold. In this embodiment of the present invention a slight excess of casting resin formulation can be used, which improves the flowability of the casting resin powder formulation thus produced. When the mold is being filled it is set in vibration by a suitable device, for example a compressed air vibrator, with the result that the casting resin powder formulation is thoroughly intermixed and "fluidized." The casting resin powder formulation is simultaneously degassed.

Because the mixture of dielectric powder and alloy powder has a very high density compared to the casting resin, the alloy powder is easily placed into the mold, so that the excess casting resin used can be collected in a gate, for example, which can be removed after the powder composite has cured. The use of molds which are already provided with prefabricated windings enables inductive components to be manufactured in one operation, without the necessity for subsequent very labor-intensive "spooling" or application of prefabricated windings to partial cores and then assembling the partial cores into complete cores.

In one preferred embodiment of the invention, the mold, which is filled with the alloy powder and the casting resin formulation or into which a preprepared casting resin powder formulation has already been poured, is "further used" as the housing for the inductive component. In other words, in this embodiment of the present invention the mold is used as "dead casing." Use of this procedure provides a particularly effective and economical method which, particularly in contrast to the aforementioned injection molding process, is simplified significantly. In the aforementioned injection molding process, a mold is always required which in addition to being very costly is expensive to manufacture, and which can never be used as "dead casing."

As casting resin formulations, polymeric building blocks are typically used which are mixed with a polymerization initiator (starter). Methacrylic acid methyl esters in particular come into consideration as polymeric building blocks. However, other polymeric building blocks, for example lactams, are possible. The methacrylic acid methyl esters are then polymerized to polyacryl during curing. By analogy, the lactams are polymerized to polyamides via an polyaddition reaction.

Dibenzoyl peroxide, or also 2,2'-azoisobutyric acid dinitryl, for example, come into consideration as polymerization initiators.

However, other polymerization processes for the known casting resins are also possible, such as polymerizations initiated by light or UV radiation, that is, which essentially dispense with polymerization initiators.

In one particularly preferred embodiment, the mixtures of the ferromagnetic alloy powder and the dielectric powder are aligned by application of a magnetic field while and/or after the mold is filled with the powder mixture. Particularly for molds which are already provided with a winding, this can be achieved by passing a current through the winding and producing the associated magnetic field. The ferromagnetic alloy articles as well as the ferromagnetic dielectric powder particles are aligned by this application of magnetic fields with field intensities of preferably greater than 10 A/cm.

It is particularly advantageous to align the ferromagnetic particles which are formanisotropic along the magnetic field lines present in the subsequently operated inductive component. In particular by aligning the alloy particles with their "long" axis parallel to the magnetic field lines, it is possible to greatly reduce the losses and to increase the permeability of the soft magnetic core, thereby achieving the inductivity of the inductive component.

When a casting resin powder formulation is used, in order to achieve higher permeabilities of the soft magnetic core it is advantageous when the casting resin powder formulation is being poured in to create a magnetic field with the coil present in the mold, which causes the alloy particles and the dielectric powder particles to align in the direction of the magnetic flux.

After the mold is completely filled it is set in vibration, which can be accomplished using the aforementioned compressed air vibrator, after which the magnetizing current is shut off. After the final curing of the casting resin formulation the resulting inductive component is released from the mold.

The invention is explained below, with reference to one exemplary embodiment and the accompanying drawing.

The FIGURE shows an inductive component according to the present invention in cross section.

The FIGURE shows an inductive component 10. Inductive component 10 comprises a soft magnetic core 11 and a winding 12 made of relatively thick copper wire with few windings. The FIGURE shows component 10 during manufacture. Component 10 is introduced into a mold 1, which is made of aluminum here.

Winding 12 is a multilayer winding bobbin whose winding ends are attached to pins 13. Pins 13 project from soft magnetic core 11 and are used to connect to a base plate, for example a printed circuit board. Mold 1 shown is simultaneously used as a housing 14.

The starting material for the powder composite is an initially amorphous alloy, having the composition $Fe_{73.5}Cu_1Nb_3Si_{15.5}B_7$, produced in the form of thin metal ribbons by rapid solidification technology. Once again it is expressly noted that these manufacturing methods are explained in detail in EP 0 241 657 A2.

These alloy ribbons then undergo heat treatment under a hydrogen blanket or under vacuum at a temperature of approximately 560° C. to create a nanocrystalline structure. Following this crystallization treatment the alloy ribbons were comminuted in a mill to the desired end fineness. The typical alloy particle sizes resulting for this process have a thickness of approximately 0.01 to 0.04 mm and a size of 0.04 to 1.0 mm in the other two dimensions.

The alloy particles thus produced, also referred to as flakes, were then provided with a surface coating to improve their dynamic magnetic properties. To this end, first a targeted surface oxidation of the alloy particles was carried out by heat treatment at a temperature ranging between 400° C. and 540° C. for a period of 0.1 to 5 hours. Following this treatment the surface of the alloy particles was coated with an abrasion-resistant layer made of iron and silicon oxide having a typical layer thickness of approximately 150 to 400 nm.

Following this surface oxidation the alloy particles were coated with a silane in a fluidized bed coater. The layer was then "burned in" at temperatures between 80° C. and 200° C. over a period of 0.1 to 3 hours.

An iron carbonyl powder of HQi quality from BASF was then prepared. The iron carbonyl powder had a particle size distribution of less than 5 μm. The surface-oxidized alloy powder and the iron carbonyl powder were then mixed together in a weight ratio of approximately 7:3; that is, approximately 7 kg alloy powder were mixed with approximately 3 kg iron carbonyl powder.

Both powders were homogenized in a suitable mixer and then poured into the desired mold.

The powder mixture thus prepared was then poured into mold 1. Mold 1 made of aluminum had a suitable separation coating on its inner wall, thereby preventing difficulties in releasing inductive component 10 from the mold. An electric current was then passed through winding 12 so that the ferromagnetic alloy particles and the ferromagnetic dielectric powder particles aligned with their "long axis" parallel to the resulting magnetic field, which was approximately 12 A/cm.

A casting resin formulation was then poured into the filled mold.

The casting resin formulation used was composed of a thermoplastic methacrylate formulation with a silane bonding agent. This thermoplastic methacrylate formulation had the following composition:

100 g methacrylic acid methyl ester 2 g methacryltrimethoxysilane 6 g dibenzoyl peroxide and 4.5 g N, N-dimethyl-p-toluidine The chemical components were successively dissolved in methacrylic ester. The final mixture was transparent, and was poured into mold 1. The casting resin formulation cured at room temperature within approximately 60 minutes. The formulation was then aftercured at approximately 150° C. for another hour.

A magnetic core was obtained which had a packing density of ferromagnetic material in the range of approximately 65 vol %.

The invention claimed is:

1. An inductive component comprising:

(1) at least one winding; and (2) a soft magnetic core molded about the at least one winding, the soft magnetic core being made of a ferromagnetic powder composite, the ferromagnetic powder composite comprising:

a. a ferromagnetic alloy powder, comprising:

(i) amorphous or nanocrystalline alloy particles that are surface-oxidized; and (ii) a ferromagnetic dielectric powder, and b. a cured resin resulting from curing a pourable casting resin formulation that has been poured into a mold about the at least one winding.

2. Inductive component according to claim 1, wherein the ferromagnetic dielectric powder comprises an inorganic ferromagnetic powder.

3. Inductive component according to claim 2, wherein the inorganic ferromagnetic powder comprises a ferrite powder.

4. Inductive component according to claim 1, wherein the ferromagnetic dielectric powder comprises a surface-insulated metallic powder.

5. Inductive component according to claim 4, wherein the surface-insulated metallic powder comprises a ferromagnetic metal carbonyl powder or a mixture of ferromagnetic metal carbonyl powders.

6. Inductive component according to claim 5, wherein the ferromagnetic metal carbonyl powder comprises iron carbonyl powder or nickel carbonyl powder or cobalt carbonyl powder or mixtures thereof.

7. Inductive component according to one of claim 1, wherein the ferromagnetic dielectric powder is composed of powder particles with an average powder particle size <10 μm.

8. Inductive component according to claim 7, wherein the ferromagnetic dielectric powder is composed of powder particles with an average powder particle size <5 μm.

9. Inductive component according to claim 1, wherein the surface-oxidized amorphous or nanocrystalline alloy particles have an average particle size <2 μm.

10. Inductive component according to claim 9, wherein the surface-oxidized amorphous or nanocrystalline alloy particles have a dimension that averages between 0.04 mm and 0.5 mm.

11. Inductive component according to claim 1 wherein the surface-oxidized amorphous or nanocrystalline alloy particles are coated with a plastic.

12. Inductive component according to claim 11, wherein the plastic comprises a silane.

13. Inductive component according to claim 1, wherein the ferromagnetic powder composite has a saturation magnetization $B_s$>0.5 Tesla and a permeability $10 \leqq \mu \leqq 200$.

14. Inductive component according to claim 1, wherein the casting resin formulation comprises a monomeric or oligomeric resin from which a polyamide, a polyacrylate, or a polybutylene terephthalate resin is formed.

15. Inductive component according to claim 1, wherein the inductive component further comprises a housing.

16. Inductive component according to claim 1, wherein the ferromagnetic alloy powder and the pourable casting resin formulation are mixed prior to being molded about the at least one winding.

17. Inductive component according to claim 1 in which (a) the at least one winding defines a central space and (b) at least a portion of the soft magnetic core is molded into the central space.

18. Inductive component according to claim 1, wherein the ferromagnetic alloy powder comprises nanocrystalline alloy particles that are surface-oxidized.

19. An inductive component comprising:

(i) a mold comprising at least one winding; and (ii) a soft magnetic core comprising a ferromagnetic powder composite comprising a mixture of:

a. a ferromagnetic alloy powder comprising:

(1) amorphous or nanocrystalline alloy particles that are surface-oxidized, and (2) a ferromagnetic dielectric powder; and b. a cured resin formed by curing a pourable casting resin formulation poured into the mold.

20. An inductive component comprising:

(1) at least one winding; and (2) a soft magnetic core molded about the at least one winding, the soft magnetic core being made of a ferromagnetic powder composite, the ferromagnetic powder composite comprising:

a. a ferromagnetic alloy powder, comprising:

(i) amorphous or nanocrystalline alloy particles that are surface-oxidized and have an average particle size <2 mm, a thickness from 0.01 to 0.04 mm, and sizes in the other two dimensions from 0.04 to 1.0 mm; and (ii) a ferromagnetic dielectric powder, selected from ferrite powder and one or more ferromagnetic metal carbonyl powders, each having an average particle size <10 μm, and b. a cured polyamide, polyacrylate, or polybutylene terephthalate resin resulting from curing a pourable casting resin formulation that has been poured into a mold about the at least one winding.

* * * * *